US010661330B2

(12) United States Patent
Naue et al.

(10) Patent No.: US 10,661,330 B2
(45) Date of Patent: May 26, 2020

(54) METHOD FOR PRODUCING A FLAT SPIRAL SPRING, AND BENDING DEVICE FOR PRODUCING SAME

(71) Applicant: Adolf Schnorr GmbH + Co. KG, Sindelfingen (DE)

(72) Inventors: Knut Naue, Stuttgart-Monchfeld (DE); Andy Haunholter, Sindelfingen (DE)

(73) Assignee: Adolf Schnorr GmbH + Co. KG, Sindelfingen (DE)

( * ) Notice: Subject to any disclaimer, the term of this patent is extended or adjusted under 35 U.S.C. 154(b) by 377 days.

(21) Appl. No.: 15/500,939

(22) PCT Filed: Jul. 31, 2015

(86) PCT No.: PCT/EP2015/067712
§ 371 (c)(1),
(2) Date: Feb. 1, 2017

(87) PCT Pub. No.: WO2016/020294
PCT Pub. Date: Feb. 11, 2016

(65) Prior Publication Data

US 2017/0216905 A1 Aug. 3, 2017

(30) Foreign Application Priority Data

Aug. 4, 2014 (DE) ..... 10 2014 111 015

(51) Int. Cl.
*B21F 3/00* (2006.01)
*B21F 35/04* (2006.01)
(Continued)

(52) U.S. Cl.
CPC ..... *B21F 35/04* (2013.01); *B21D 5/143* (2013.01); *B21D 11/10* (2013.01); *B21D 53/16* (2013.01);
(Continued)

(58) Field of Classification Search
CPC .... B21F 35/04; B21F 3/08; B21F 3/04; B21F 37/04; B21D 53/886; B21D 11/10; B21D 53/84; B21D 53/16; B21D 5/143
See application file for complete search history.

(56) References Cited

U.S. PATENT DOCUMENTS 2,736,674 A * 2/1956 Harmon ..... B21K 1/32 148/693
3,608,347 A 9/1971 Kemminer
(Continued)

FOREIGN PATENT DOCUMENTS

CN 202762794 U 3/2013
DE 17 52 683 B1 12/1971
(Continued)

OTHER PUBLICATIONS

Machine Translation of JPS5575818A (Year: 1980).*
(Continued)

*Primary Examiner* — Sarang Afzali
*Assistant Examiner* — Ruth G Hidalgo-Hernandez
(74) *Attorney, Agent, or Firm* — Renner, Otto, Boisselle & Sklar, LLP

(57) ABSTRACT

A method for producing a flat spiral spring formed as an annular disk-shaped segment, wherein a strip-shaped material is supplied in a tangential alignment to the lateral surface of the drum such that a lateral wall which determines the thickness of the strip-shaped material rests against some sections of a contact surface on the lateral surface of the drum. The contact surface of the drum has a radius which substantially corresponds to an internal radius of the strip-shaped material, and at least one deflecting device is aligned at a distance to the drum such that the strip-shaped material is guided in a forced manner between the drum and the
(Continued)

Figure 1A:
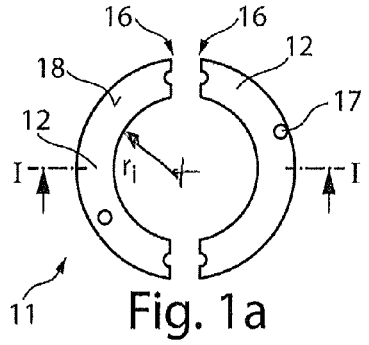

deflecting device, and the strip-shaped material is bent so as to follow the drum by means of the deflecting device.

14 Claims, 2 Drawing Sheets

(51) Int. Cl.

| | |
|---|---|
| ***B21D 5/14*** | (2006.01) |
| ***B21D 11/10*** | (2006.01) |
| ***B21F 37/04*** | (2006.01) |
| ***B21F 3/04*** | (2006.01) |
| ***B21D 53/16*** | (2006.01) |
| ***B21D 53/84*** | (2006.01) |
| ***B21F 3/08*** | (2006.01) |
| ***B21D 53/88*** | (2006.01) |

(52) U.S. Cl.
CPC ..... *B21D 53/84* (2013.01); *B21D 53/886* (2013.01); *B21F 3/04* (2013.01); *B21F 3/08* (2013.01); *B21F 37/04* (2013.01)

(56) References Cited

U.S. PATENT DOCUMENTS

| | | | |
|---|---|---|---|
| 3,729,968 | A | 5/1973 | Norris |
| 5,261,363 | A | 11/1993 | Kemnitz |
| 2007/0183867 | A1 | 8/2007 | Hesselmann et al. |

FOREIGN PATENT DOCUMENTS

| | | | |
|---|---|---|---|
| DE | 42 08 037 | C2 | 9/1993 |
| GB | 1 248 473 | A | 10/1971 |
| JP | S55 75818 | A | 6/1980 |
| JP | H01 210127 | A | 8/1989 |
| JP | 2002-307121 | A1 | 10/2002 |
| JP | 2011 052777 | A | 3/2011 |
| WO | 2006/018313 | A1 | 2/2006 |

OTHER PUBLICATIONS

Machine Translation of DE1752683 (Year: 1968).*
International Search Report and Written Opinion for corresponding Patent Application No. PCT/EP2015/067712 dated Oct. 21, 2015.
International Preliminary Report on Patentability for corresponding Patent Application No. PCT/EP2015/067712 dated Feb. 7, 2017.

* cited by examiner

METHOD FOR PRODUCING A FLAT SPIRAL SPRING, AND BENDING DEVICE FOR PRODUCING SAME

Method for the production of a leaf spring, as well as a bending device for its production.

The invention relates to a method for the production of a leaf spring, in particular a spring steel sheet for covering a cooling chamber of a piston of internal combustion engines, which is at least formed as a washer-shaped segment, as well as a bending device for its production.

The production of a two or multi-segment plate spring is known from DE 42 08 037 C2, which is used as the cover of a cooling chamber for pistons of internal combustion engines. This two-part plate spring includes a cooling oil annular channel opening towards the piston shaft and is supported on annular channel partition walls. This forms a closed cooling oil chamber, wherein corresponding holes are provided in the plate spring for the infeed or outfeed of the cooling oil, or the butt joints of the two segments of the plate spring are formed to be of a correspondingly large size. Such segments of the plate spring are individually punched from a band-shaped material, then raised with a tool and subsequently subjected to a setting process and a subsequent annealing process. The punching out of such segments from a band-shaped material has the disadvantage that a considerable number of offcuts are produced.

A bending device is known from JP 2002-307121 A1, by means of which a spiral-shaped wave spring is produced from a wire-shaped material. The wire-shaped material is bent into the shape of a washer, wherein a drum internally engages with the wire-shaped material, and two diverting mechanisms that are spaced at a distance apart from each other are provided outside the wire-shaped material, said diverting mechanisms being offset to each other by 90°. Furthermore, further bending devices engage offset by a further 90° on the outer circumference in order to orientate the wire-shaped material to a wave shape. The inner drum and the external diverting mechanisms are formed with equally large diameters, wherein their distance to one another determines the bending radius of the wire-shaped material. This arrangement has the disadvantage that the wire-shaped material must be of very high quality, i.e. very homogeneous, in order to achieve sufficient bending and orientation of the wire-shaped material.

The object of the invention is to propose a method for producing a leaf spring which is formed as a washer-shaped segment and which allows a dimensionally accurate production of the segments, as well as a reduction of offcuts.

This object is solved by a method having the features of claim 1. Further advantageous embodiments are specified in the further claims.

By the infeed of a band-shaped material in a tangential direction to the drum of a bending device, and with a narrow side of the annular material, which is in contact with the drum at least in sections, this band-shaped material is bent around its vertical axis in order to produce washer-shaped segments. A contact surface is provided on the drum for guiding along the band-shaped material and for bending into a washer-shaped segment, said contact surface comprising a radius which substantially corresponds to an internal diameter of the band-shaped material to be bent into the segment. As a result of this, the narrow side of the band-shaped material that engages on the contact surface of the drum is guided along a predetermined angle of contact on the contact surface. Such a production method uses the entire web width of the band-shaped material for producing washer-shaped segments. By cutting the bent band-shaped material to length, a circumferential angle of the segments is determined. For the production of such washer-shaped segments, a side wall that determines the thickness of the band-shaped material is guided along the contact surface on the shell surface of the drum and, by means of at least one diverting mechanism, is bent out of a linear section orientated in the direction of transport or in the X direction of the band-shaped material. This resulting bending around the vertical axis or Z-axis of the band-shaped material furthermore has the advantage that the direction of rolling of the band-shaped material extends along the washer-shaped segment, whereby improved spring properties and increased strength are also achieved.

Preferably an upper or under side or both sides of the band-shaped material for orientating the band-shaped material during the bending process are guided and orientated along the contact surface of the shell surface of the drum by means of at least one guiding element. By means of the at least one guiding element, spreading of the material during the bending of the band-shaped material around the Z-axis can be prevented, and the band-shaped material can be forcibly guided along the drum for the introduction of the bending radius.

According to a first embodiment, the at least one guiding element is orientated at a right angle to the axis of rotation of the drum, or it extends in a plane at a right angle to the axis of rotation. The result of this is only a bending of the band-shaped material around the Z-axis. The diameter of the drum determines the bending radius of the band-shaped material around the Z-axis.

Alternatively, the at least one guiding element is orientated with its guiding surfaces inclined relative to an XY plane, which is perpendicularly orientated to the axis of rotation or Z-axis of the drum in order to allow simultaneous installation of the washer-shaped segment during the bending process of the band-shaped material into a washer-shaped segment. As a result of this, two method steps the bending and installation of the washer-shaped segment can be carried out simultaneously.

The band-shaped material is trimmed to form the segment depending on the necessary circumferential angle of the leaf spring. This circumferential angle or angle of contact can be determined depending on the number of individual segments on leaf springs for this particular application. For example, angles of contact of around 180° can be provided when using two segments of the leaf spring. Equally, angles of contact of at least 60° can be provided. For example, the angle of contact is 120° when, e.g., using three leaf spring segments assigned to one another. In isolated cases, angles of contact of more than 180° and an additional angle of contact of less than 180° can also be formed, which is preferably complementary to the segment with an angle of contact of more than 180°.

An alternative embodiment of the method provides that the band-shaped material is wrapped several times around the drum and produced as a spiral. Cutting of the individual segments out of the spiral can be carried out either after the complete removal of the spiral from the drum, or upon the release of the spiral from the shell surface of the drum.

A first embodiment of the method provides that the drum has a contact surface situated in the shell surface. This represents the simplest embodiment of the bending device and allows the side wall of the band-shaped material to be able to roll off on the shell surface or be supported during the bending process, and for the band-shaped material, during the bending process, to be forcibly guided to bending by at least one guiding element and at least one diverting element to the drum.

Alternatively, the contact surface is introduced into the shell surface of the drum of the bending device and is recessed, and a circumferential groove is also preferably provided, in which a peripheral area of the band-shaped material bordering on the side wall of the band-shaped material is guided during the bending process. This circumferential groove can be provided both during the orientation of the band-shaped material towards the drum in an XY plane perpendicularly to the Z plane or the axis of rotation of the drum, and also in a plane inclined relative to the XY plane.

In the case of an inclined guiding of the band-shaped material towards the shell surface of the drum, provision is preferably made for the adaptation and orientation of the contact surface of the groove to the angle of installation of the band-shaped material to produce the segment so that the side face can be supported on the base area of the groove.

In a further embodiment of the method, wherein the band-shaped material bent around the Z-axis and guided in an XY plane is cut as a segment, it is introduced into a tool, particularly a bending or installation tool, in order to install the segment. By means of this, a pretension can be introduced into the segment for specific spring characteristics.

According to a further embodiment of the method, the segment, which has been bent and raised from the band-shaped material, is introduced at least into a punching tool, in which a contour, in particular an end contour of the segment, is punched out. Subsequently, plane pressing of the raised segment can be carried out in a further tool, or vice versa. A follow-on tool is preferably provided in order to reduce the manipulation of the individual segments, as well as to retain an exact positioning of the segments in the tool. Preferably, both plane pressing and simultaneous stamping into an end contour are carried out in a punching tool.

In a subsequent method step, the contoured segment can be hardened in the case that the band-shaped material is provided as a so-called soft band. In the case that the band-shaped material is made from a hardened and tempered raw material, immediate provision can be made for a tempering or an annealing process of the raw material and not only after the hardening process, on which raw material a subsequent surface coating or hardening and tempering of the surface can be undertaken. Such surface treatments can involve, e.g., oiling, phosphating or similar.

In the method for producing the leaf spring, preferably a material which is of a rectangular or trapezoidal shape in the cross-section, particularly a material which is slightly trapezoidal-shaped, is fed in.

In this method for producing the leaf spring, the band-shaped material is preferably positioned with a ratio of width to thickness of equal to or greater than 3. As a result of this, it is not possible for compression on the internal diameter and cracks on the external diameter to arise during the bending process.

The object of the invention is further solved by a bending device for producing a leaf spring, which is at least formed as a washer-shaped segment and, in particular, for carrying out the method described above, in which a drum with a contact surface to a shell surface of the drum for a narrow side of the band-shaped material is provided, and which comprises at least one diverting mechanism which is adjustable in distance to the drum, wherein the distance corresponds to the width of the band-shaped material, and the contact surface of the drum has a radius which substantially corresponds to the internal radius of a washer-shaped segment to be bent. This bending device has the advantage that the bent, band-shaped material with its inner narrow side is guided along the drum, whereby a more precise introduction of the radius is made possible. At least one diverting mechanism, which is assigned to the drum, allows the band-shaped material to be guided along the drum even if the angle of contact of the band-shaped material increases. This prevents an expansion of the bent, band-shaped material.

Provision is preferably made for the attachment of the drum to the bending device in the shell surface of the drum. By means of this, the drum can be formed as a cylindrical body. Alternatively, the contact surface can be recessed relative to the shell surface of the drum, and preferably a circumferential groove formed in the shell surface. As a result of this, at least one peripheral area of the band-shaped material bordering on the narrow side can be guided through the drum, so that the inner circumference of the band-shaped material cannot spread in or counter to a Z-axis of the drum.

Furthermore, the depth of the groove in the drum is adapted to the width of the band-shaped material, wherein at least 5% of the width of the band-shaped material is taken in by the groove. As a result of this, the groove of the band-shaped material can be guided through the drum, whereby further guiding elements to orientate the band-shaped material to the drum may be dispensed with.

A further preferred embodiment of the drum for the bending device provides that the contact surfaces of the circumferential groove are orientated at an angle to the longitudinal axis of the drum of preferably less than 90°, so that the band-shaped material is simultaneously bent and raised. As a result of this, an additional work stage, the installation of the segment, can be integrated during the bending of the washer-shaped segment.

A further preferred embodiment of the method provides that the drum of the bending device is formed in two parts with an upper part and lower part, and is introduced into a first part of a circumferential groove as a ledge on a lower part of the drum, as well as the second part of the groove being formed by means of a contact surface on the upper part, which is positioned level or at an angle to the lower part. This may allow the production of different thicknesses of the band-shaped material to be simplified, due to the fact that the distance between the upper part and the lower part is adjustable.

Figure 1B:
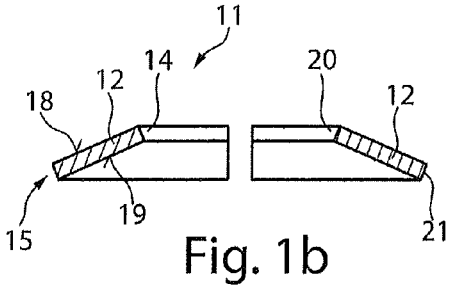
Figure 2A:
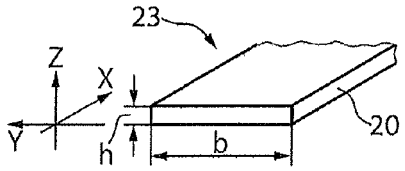
Figure 2B:
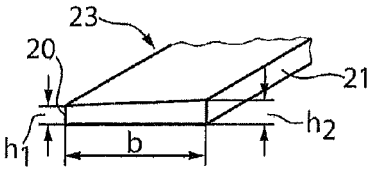
Figure 2C:
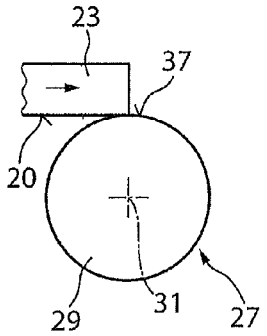
Figure 2D:
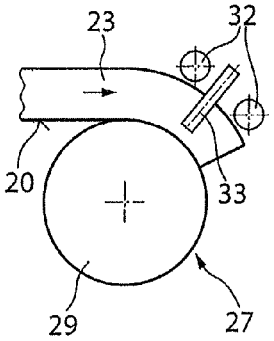
Figure 2E:
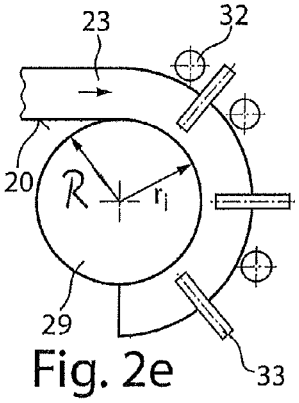
Figure 3:
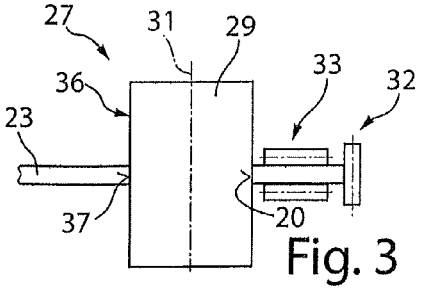
Figure 4:
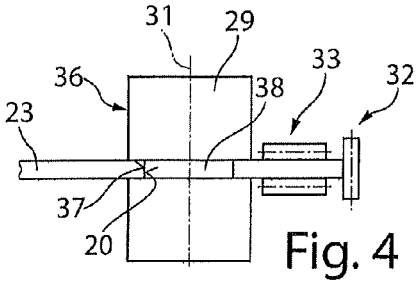
Figure 5:
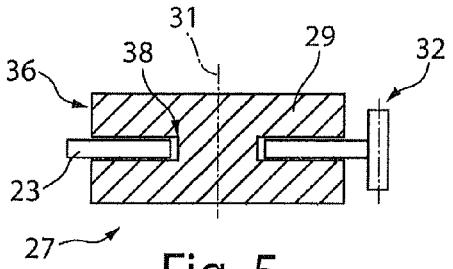
Figure 6:
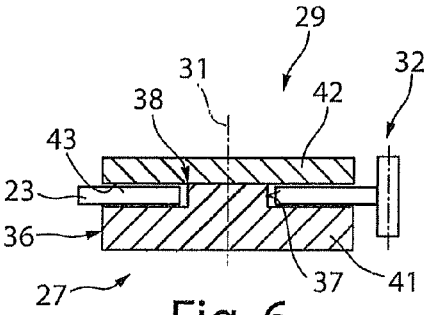
Figure 7:
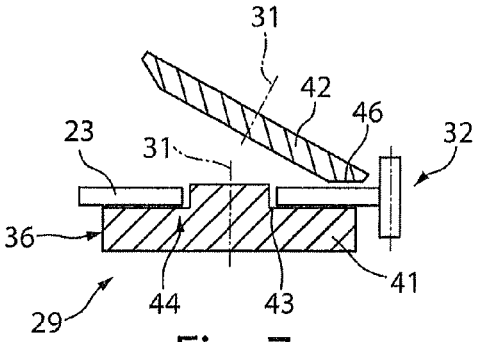
Figure 8:
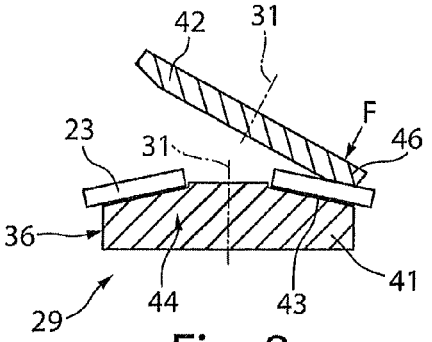
Figure 9:
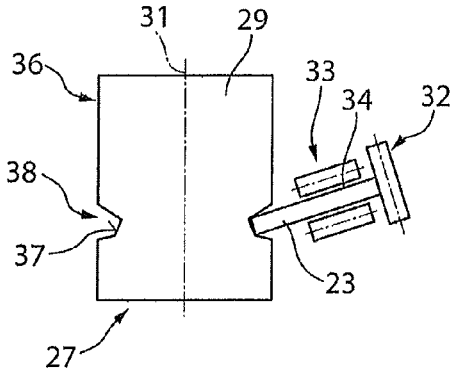
Figure 10:
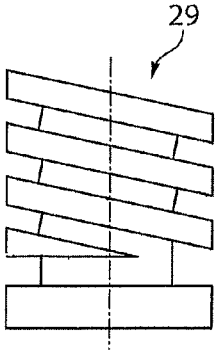

The invention and further advantageous embodiments and developments of the same are described in more detail and explained in the following by means of the examples shown in the drawings. The features that arise from the description and the drawings can be applied individually or collectively in any combination according to the invention. The following are shown:

FIG. 1*a* A schematic view from above of two leaf springs,

FIG. 1*b* A schematic sectional view along the I-I line in FIG. 1*a*,

FIG. 2*a* A perspective view of a band-shaped material for producing a leaf spring, FIG. 2*b* A schematic side view of an alternative embodiment to FIG. 2*a*, FIGS. 2*c* to 2*e* Schematic views of method steps for producing the leaf spring in accordance with FIGS. 1*a* and 1*b*, FIG. 3 A schematic side view of the method step in accordance with FIG. 2*d*, FIG. 4 A further schematic side view of an alternative embodiment to FIG. 3, FIG. 5 A schematic side view of a further alternative embodiment to FIG. 3, FIG. 6 A schematic side view of a further alternative embodiment to FIG. 3, FIG. 7 A schematic view of a further alternative embodiment to FIG. 6, FIG. 8 A schematic view of a further alternative embodiment to FIG. 7, FIG. 9 A schematic view of a further alternative embodiment to FIG. 3 and FIG. 10 A schematic view of an alternative embodiment of a drum for a bending device.

In FIG. 1*a*, a schematic view from above of two leaf springs 11 is shown, both of which are formed as a washer-shaped segment 12. Both leaf springs 11 can form a washer upon their arrangement relative to one another, which e.g. can be used as a cover for a cooling oil channel on a piston for internal combustion engines. Upon arrangement in the cooling oil channel, the respective ends of the leaf springs 11 can form a crack in order to allow the infeed or outfeed of the cooling liquid or an oil.

In FIG. 1*b*, a schematic sectional view along the line I-I in FIG. 1*a* is shown, which shows that, in the exemplary embodiment, the segments 12 are raised. This means that an internal diameter 14 is outside or above a supporting surface of the external diameter 15 of the segments 12, so that the segments 12 have a plate spring shaped arrangement. These segments 12 are preferably formed washer-shaped. The angle of contact of the segments 12 depends on the number of the segments to be used and the areas to be covered. The segments 12 can have specially formed end sections 16 that are adapted to the installation situation in order to fit closely together or to form a crack of a predefined width. In the same way, these may have correspondingly adapted contours on the external internal diameter, or also within the segment area e.g. holes 17 or further insertions, punch-outs, contours or similar. The segment 12 has an upper side 18 and an under side 19. These are bordered on the internal diameter 14 by an internal side wall 20 and on the external diameter 15 by an external side wall 21.

These segments 12 preferably consist of a band-shaped material 23, which comprises e.g. a rectangular cross-section shown in FIG. 2*a*. Such band-shaped materials are preferably produced by a rolling process. Here, provision is made for a width w to comprise multiples of a thickness or height h. The ratio is at least w/h 5, particularly w/h 10. The band-shaped material 23 can be formed as reels or individual strips. To simplify the following explanations, the system of coordinates shown in FIG. 2*a* is referred to, wherein the orientation of the coordinates may differ from the spatial directions shown.

In FIG. 2*b*, an alternative embodiment of a cross-section for a band-shaped material 23 is shown, which just like the material shown in FIG. 2*a* can be used for a band-shaped material 23. This cross-section is only slightly trapezoidal-shaped, so that an inner side 20 is formed more thinly than the external side 21.

Provision is made for a bending device 27 for producing the leaf springs 11 from a band-shaped material 23 in accordance with FIG. 2*a* or 2*b*, which is shown in a top view and in individual work stages in FIGS. 2*c*, 2*d* and 2*e* and in a side view, as well as in FIG. 3.

The bending device 27 comprises a drum 29, which is rotary driven around a preferably fixed axis of rotation 31. This axis of rotation 31 can be orientated in the Z direction. At least one diverting mechanism 32 is provided spaced from the drum 29, said diverting mechanism 32 being formed, for example, as a cylinder or roller and preferably also being rotatable around an axis of rotation parallel to the axis of rotation 31. The bending device 27 furthermore comprises at least one guiding element 33 having at least one sliding surface 34 which is used to guide and orientate the band-shaped material 23 relative to the contact surface 37 of a shell surface 36 of the drum 29. The guiding element 33 can have fixed sliding surfaces 34.

Alternatively, the sliding surfaces 34 can also be formed by rollers or cylinders that are rotatable or revolving.

In the following, the production of a segment 12 in accordance with FIGS. 1*a* and 1*b* is discussed in more detail:

In a first method step in accordance with FIG. 2*c*, the band-shaped material 23 is fed tangentially into a shell surface 36 of the drum 29. During this process, an inner side wall 20 comes into contact with the contact surface 37 of the shell surface 36 of the drum 29. The upper and under side 18, 19 of the band-shaped material 23 are orientated in a vertical position relative to the axis of rotation 31. In the diagram in accordance with FIG. 2*c*, the axis of rotation 31 can be the Z axis, but also orientated in an XY plane. The drum 29 can preferably be rotary driven by an engine. At the same time, the band-shaped material 23 is further advanced in accordance with arrow A, so that it is bent via the diverting mechanism 32 around its vertical axis or Z-axis and the inner side wall 20 continues to come into contact with the shell surface 36. The inner side wall 20 is compressed as a result of this, and an external side wall 21 is stretched by this. The curvature radius or bending radius of the segment 21 depends on the material, the thickness and/or the width of the band-shaped material. For fixing and orientating the band-shaped material 23 to the drum 29, a guiding element 33, for example, is provided, so that the band-shaped material, as is e.g. shown in FIG. 3, is in contact with the side surface 20 on the shell surface 36 and the band-shaped material 23 is bent around the narrow side i.e. the inner side wall 20. If the infeed of the band-shaped material 23 according to FIG. 2*e* continues, the band-shaped material 23 may be further bent around the Z-axis so that, e.g., an 180° bend is achieved. The number and arrangement of the diverting mechanisms 32 and/or the guiding elements 33 depends on the bending radius, the material used, the material width and/or further parameters.

After a front end of the band-shaped material 23 comprises a sufficient angle of contact, an incision is made in the region where the band-shaped material 23 is fed into the drum 29 in order to cut the segment 12.

Alternatively, the length of the band-shaped material 23 can be predefined so that individual strips of the band-shaped material 23 are fed to the bending device 27 with the predetermined length, and separation of the segment 23 from the band-shaped material may be dispensed with.

A further alternative embodiment provides that a band-shaped material 23 is fed in and the band material bent around the drum 29 forms around the drum 29 in a helical or spiral shape, and is guided off in an upwards or downwards direction, so that either an incision is made once the spiral is guided out relative to the shell surface 36, or after the spiral has been completely removed from the drum 29, the segments 12 are cut.

Provision is made in this first embodiment of the drum 29 of the bending device 27 for this to have a level or smooth shell surface 36, and for the contact surface 37 to be situated in the shell surface 36, as shown in FIG. 3. A radius R of the drum 29 that determines the contact surface 37 corresponds to an inner radius n of the segment 12, as is e.g. shown in FIGS. 2*e* and 1*a*. In the embodiment according to FIG. 3, the radius R of the shell surface 36 corresponds to the radius of the contact surface 37.

An alternative embodiment of the drum 29 of the bending device 27 is shown in FIG. 4. The contact surface 37 is introduced into the shell surface 36 and by this action, forms e.g. a circumferential groove 38, which is preferably adapted in the width of the height h of the band-shaped material 23 to be processed, so that this band-shaped material 23 is held with the inner side wall 20 in this groove 38, and is captured in the peripheral area of the upper side 18 and under side 19 of the segment 12. In this embodiment, the depth of the groove 38 is preferably measured in such a way that only a narrow peripheral area of the upper and under side 18, 19 engages in the groove 38. The depth of the groove 38 is formed by the radius of the contact surface 37, which in turn corresponds to the inner radius n of the segment to be produced 12. Alternatively, the groove 38 can also be formed in such a way that the shaped wall segments between the shell surface 36 and the contact surface 37 are also formed in a flat and V-shape, or they drastically expand from the contact surface 37 to the drum surface 3, so that e.g. there is no guiding function relating to the upper and under side 18, 19 of the band-shaped material 23.

In FIG. 5, an alternative embodiment to FIG. 4 is shown. Here, the contact surface 37 of the drum 29 has a depth that extends across at least half of the width of the band-shaped material 23. Advantageously, a groove 38 is formed, the width of which corresponds to the material thickness of the material 23, or is slightly larger. In this embodiment, the guiding elements 33 may no longer be needed, since due to the depth of the groove 38, the groove-forming peripheral sections form the guiding elements 33. The band-shaped material is held in place in the groove 38 of the shell surface 36 only by the diverting mechanism 32.

In FIG. 6, a further alternative embodiment of the drum 29 of the bending device 37 is shown. In this embodiment, unlike in FIG. 5, the drum 29 is formed in two parts and consists of a lower part 41 and an upper part 42. The lower part 41 has a ledge 44 on which the contact surface 37 is provided, wherein the ledge 44 together with the upper part 42 in turn forms the groove 38. This embodiment has the advantage that, depending on the setting of the distance of a contact surface 43 on the upper part 42 relative to the lower part 41, the width of the groove 38 can be altered.

This alternative embodiment according to FIG. 6 can also comprise a groove 38, which is shown and described in FIG. 4.

In FIG. 7, a further alternative embodiment of the bending device 27 is shown, wherein the construction of this embodiment corresponds to the two-part drum 29 in accordance with FIG. 6. In this embodiment in FIG. 7, the axis of rotation 31 of the upper part 42 is arranged at an angle deviating from that of the lower part 41. Preferably, the upper part 42 and the lower part 41 are attached to each other in a non-rotating manner by means of a cardan joint. The distance of the upper part 42 to the lower part 41 can be altered for setting the groove width. As a result of this, the upper part 42 is arranged at an angle to the lower part 41, wherein a contact area 46 is formed on the external border of the upper part and engages on the band-shaped material 23, and this is held down onto the contact surface or the contact surface on the ledge 44. In this two-part embodiment of the drum 29, the guiding element 33 is again not necessary. Furthermore, this embodiment enables a simple infeed of the band-shaped material 23 into the groove 38, which is formed in the area of the sections of the upper part 42 and the lower part 41 inclined relative to each other. Due to the fact that the upper part 42 and the lower part 41 are orientated relative to one another in a non-rotating manner and at an angle, this infeed can be simplified and effectuated. Furthermore, one or more diverting mechanisms 32 can be provided, as also in the previously described embodiments, in order to effect the bending of the band-shaped material 23 around the Z-axis.

In these described embodiments, a segment 12 is produced which is formed as a level element. In order for them to assume a form, as is shown in FIG. 1*b*, it is necessary for these segments 12 to subsequently be inserted into a tool and raised by means of a pressing or bending process. In a subsequent or prior work stage, a contour is introduced into the segments 12 by a punching tool, such as e.g. the end sections 16 and/or holes 17 or similar. After the installation of the segment 12, plane pressing to position the segment 12 is undertaken in an additional tool. If a contour or an end contour has not already been introduced into the segment 12 beforehand, after the installation of the segment both the end contour and also the plane pressing process can be introduced in a work stage in a punching and positioning tool.

In subsequent work stages, tempering or annealing and a surface treatment and/or surface coating for producing the segment can be undertaken with a hardened and tempered material as a band-shaped material 23. Provided that a soft band is used as the raw material for the band-shaped material 23, the material hardens after installation/punching and subsequently, anneals and, if necessary, a surface treatment is undertaken.

In FIG. 8, an alternative embodiment of the bending device 27 to FIG. 7 is shown. In this embodiment, the contact surface 43 is inclined on the ledge 44 of the lower part 41, and the contact area 46 or pressing surface of the upper part 42 or the angular orientation of the upper part 42 is adapted to the lower part 41. As a result of this, when the washer-shaped segment 12 is formed, the simultaneous installation of the washer-shaped segment 12 can also be achieved, so that one fewer work stage is necessary when compared with the previous method described under FIG. 7.

In FIG. 9, an alternative embodiment of the drum 29 of the bending device 27 is shown, which allows an alternative method for producing the leaf springs 11. The infeed of the band-shaped material 23 according to FIG. 2*c* is also undertaken for the drum 29, in accordance with FIG. 8. The additional steps described in FIGS. 2*d* and 2*e*, as well as in FIG. 3, also take place in this embodiment, wherein, in the steps in accordance with FIGS. 2*d* and 2*e*, for a drum 29, in accordance with FIG. 8, the installation of the band-shaped material 23 is achieved at the same time as the bending of the band-shaped material 23 around the Z-axis. For this purpose e.g., the at least one guiding element 33 with its sliding surfaces 34, is not orientated at a right angle to the axis of rotation 31, but rather at an angle to it that is determined by the desired installation degree of the segment 12, i.e. by the distance of the height of the inner diameter 14 relative to a support surface of the outer diameter 15. Provision in the case of simultaneous bending and installation is preferably made for a circumferential groove 38 to be introduced in the shell surface 36 of the drum 29, in order to allow secure support and guiding of the inner side wall 20 of the band-shaped material 23. Here, the groove 38 preferably has a base 49 which allows the inner side area 20 to preferably be situated in level contact with the base 49, and to support itself on it. This base 49 is therefore, relative to the parallel orientation towards the axis of rotation, inclined by the angle by which the sliding surfaces 34 are inclined relative to a right angle orientation towards the axis of rotation.

The drum 29 shown in FIG. 9 can also be formed in two parts with a lower part 41 and an upper part 42, wherein the parting plane can be situated analogously to that in FIG. 6.

In FIG. 10, an alternative embodiment of a drum 29 is shown. This drum 29 has a contact surface 37 in the shell surface 36 and this contact surface 37 is orientated parallel to the longitudinal axis and extends in a plane perpendicularly to the longitudinal axis of the drum 29. The contact surface 37 emerges upwards from this in a spiral shape. By means of such a drum 29, a leaf spring with several twists can be produced as a spiral spring. As soon as the first twist exits the drum 29 it can be trimmed, and the incision also only made after the desired number of twists relative to the upper side of the drum 29 have been guided out.

By means of the method according to the invention, the incision when producing the segments 12 for the leaf spring 11 is significantly minimised, since the entire band width is used for forming the segment 12, which thus results in considerable cost savings.

The invention claimed is:

1. A method for producing a washer-shaped segment that can be used to form a leaf spring, the method comprising:

feeding a band-shaped material into a bending device which includes at least one drum that rotates around an axis of rotation, the band-shaped material being fed into the bending device in a tangential orientation to a shell surface of the drum, so that a side wall of the band-shaped material that determines a thickness of the band-shaped material is in contact at least in sections with a contact surface on the shell surface of the drum, and forcibly guiding the band-shaped material between the drum and at least one diverting mechanism that is radially spaced a distance from the drum for bending the band-shaped material into the washer-shaped segment as the band-shaped material passes the at least one diverting mechanism, and wherein the contact surface is located at a radially inner end of a circumferential radial groove in the shell surface of the drum, and at least one radially extending surface of the circumferential radial groove guides an abutting axial-facing surface of the band-shaped material during feeding of the band-shaped material into the bending device, and wherein the contact surface is orientated at an angle of less than 45° relative to a rotational axis of the drum.

2. The method according to claim 1, comprising a step of using a punching tool to form an end contour of the washer-shaped segment.

3. The method according to claim 2, comprising a step of hardening the washer-shaped segment.

4. The method according to claim 2, comprising a step of subjecting the washer-shaped segment to at least one of a tempering procedure, a surface annealing procedure and a surface coating procedure.

5. The method according to claim 1, comprising a step of cutting the band-shaped material after bending around a predetermined circumferential angle of the contact surface of the drum for the formation of the washer-shaped segment of a discrete length.

6. The method according to claim 1, wherein the band-shaped material is wrapped around the drum several times to form the band-shaped material into a spiral shape.

7. The method according to claim 1, wherein the contact surface that is contacted by the side wall of the band-shaped material is flush with adjacent surfaces of the shell surface.

8. The method according to claim 1, wherein the band-shaped material being fed into the bending device is of a rectangular or trapezoidal shape in the cross-section.

9. The method according to claim 1, wherein the band-shaped material has a ratio of a width to thickness of equal to or greater than 3.

10. The method according to claim 1, wherein the washer-shaped segment is cut into discrete lengths after exiting from the bending device.

11. The method according to claim 1, wherein a spring steel sheet for covering a cooling chamber of a piston of internal combustion engines, is produced.

12. A bending device to produce a washer-shaped segment that can be used to form a leaf spring, comprising:

a rotatable drum having a contact surface on a shell surface of the rotatable drum against which can be contacted tangentially a side wall of the band-shaped material, and at least one diverting mechanism radially spaced a distance from the rotatable drum for causing the band-shaped material to bend around the rotatable drum to form the washer-shaped segment, and wherein the contact surface is located at a radially inner end of a circumferential radial groove in the shell surface of the rotatable drum such that at least one radially extending surface of the circumferential radial groove is arranged to guide an abutting axial-facing surface of the band-shaped material during feeding of the band-shaped material into the bending device, and wherein the contact surface is oriented at an angle less than 45° relative to a rotational axis of the rotatable drum.

13. The bending device according to claim 12, wherein the contact surface is recessed relative to adjacent portions of the shell surface.

14. The bending device according to claim 12, wherein the rotatable drum is formed in two parts with a lower part and an upper part, and a ledge on the lower part forms the contact surface.

* * * * *